US008109340B2

(12) United States Patent
Doane et al.

(10) Patent No.: US 8,109,340 B2
(45) Date of Patent: Feb. 7, 2012

(54) HIGH-PRESSURE/HIGH TEMPERATURE PACKER SEAL

(75) Inventors: James C. Doane, Friendswood, TX (US); Samuel I. Robinson, Austin, TX (US)

(73) Assignee: Baker Hughes Incorporated, Houston, TX (US)

( * ) Notice: Subject to any disclaimer, the term of this patent is extended or adjusted under 35 U.S.C. 154(b) by 367 days.

(21) Appl. No.: 12/493,186

(22) Filed: Jun. 27, 2009

(65) Prior Publication Data

US 2010/0326675 A1 Dec. 30, 2010

(51) Int. Cl.
*E21B 33/129* (2006.01)
*E21B 23/01* (2006.01)

(52) U.S. Cl. ..... 166/387; 166/138; 166/196; 166/216

(58) Field of Classification Search ..... 166/387, 166/118, 196, 138, 119, 216
See application file for complete search history.

(56) References Cited

U.S. PATENT DOCUMENTS

| | | | | |
|---|---|---|---|---|
| 1,188,489 | A | 6/1916 | Rhea | |
| 2,230,712 | A | 2/1941 | Bendeler et al. | 166/13 |
| 2,546,377 | A | 3/1951 | Turechek | 166/13 |
| 2,620,036 | A | 12/1952 | Morgan | 166/12 |
| 3,049,177 | A * | 8/1962 | Bonner | 166/119 |
| 3,071,960 | A | 1/1963 | Knapp et al | 73/40.5 |
| 3,287,035 | A | 11/1966 | Greenwood | 285/147 |
| 3,506,067 | A | 4/1970 | Lebourg | 166/134 |
| 3,910,348 | A | 10/1975 | Pitts | 166/134 |
| 4,415,169 | A | 11/1983 | Kim | 277/125 |
| 4,702,481 | A * | 10/1987 | Brammer | 277/328 |
| 4,719,971 | A * | 1/1988 | Owens | 166/191 |
| 4,934,459 | A | 6/1990 | Baugh et al. | 166/380 |
| 5,333,692 | A * | 8/1994 | Baugh et al. | 166/387 |
| 5,511,620 | A * | 4/1996 | Baugh et al. | 166/387 |
| 5,829,526 | A | 11/1998 | Rogers et al. | 166/291 |
| 5,890,537 | A | 4/1999 | Lavaure et al. | 166/285 |
| 6,056,053 | A | 5/2000 | Giroux et al. | 166/155 |
| 6,082,451 | A | 7/2000 | Giroux et al. | 166/72 |
| 6,182,755 | B1 | 2/2001 | Mansure | 166/180 |
| 6,321,841 | B1 | 11/2001 | Eoff et al. | 166/291 |
| 6,555,507 | B2 | 4/2003 | Chatterji et al. | 29/3 |

(Continued)

FOREIGN PATENT DOCUMENTS

WO WO 2008111843 A1 * 9/2008

OTHER PUBLICATIONS

L. Vo and J.W. Styler (Saudi Aramco), "An Assessment of Emerging Technologies for Production Optimization in Saudi Aramco-Southern Area Production Engineering," 14th SPE Middle East Oil & Gas Show and Conference. SPE 93369, Mar. 12-15, 2005, Bahrain.

(Continued)

*Primary Examiner* — Jennifer H Gay
(74) *Attorney, Agent, or Firm* — Shawn Hunter

(57) ABSTRACT

A packer device includes an elastomeric packer element which is seated upon an inner sleeve that surrounds a central inner mandrel. The inner sleeve and the inner mandrel are oriented at an angle of departure with respect to the central axis of the tool, thereby providing a ramp assembly which helps to set the packer device. An anchor ring and a retaining ring are located on opposite axial sides of the packer element and contact the surrounding tubular member.

18 Claims, 6 Drawing Sheets

U.S. PATENT DOCUMENTS

| | | | | |
|---|---|---|---|---|
| 6,705,615 | B2 * | 3/2004 | Milberger et al. | 277/328 |
| 6,742,591 | B2 | 6/2004 | Metcalfe | 166/285 |
| 6,755,256 | B2 | 6/2004 | Murley et al. | 166/381 |
| 6,769,491 | B2 | 8/2004 | Zimmerman et al. | 166/387 |
| 6,793,022 | B2 * | 9/2004 | Vick et al. | 166/382 |
| 6,869,080 | B2 | 3/2005 | Janoff et al. | 277/603 |
| 6,896,049 | B2 | 5/2005 | Moyes | 166/82.1 |
| 6,902,008 | B2 | 6/2005 | Hirth et al. | 166/387 |
| 6,962,206 | B2 * | 11/2005 | Hirth et al. | 166/387 |
| 6,969,070 | B2 * | 11/2005 | Reimert et al. | 277/323 |
| 7,004,260 | B2 | 2/2006 | Bosma et al. | 166/387 |
| 7,036,581 | B2 * | 5/2006 | Trahan | 166/186 |
| 7,070,001 | B2 | 7/2006 | Whanger et al. | 166/387 |
| 7,077,213 | B2 | 7/2006 | Cook et al. | 166/384 |
| 7,748,467 | B2 * | 7/2010 | Doane | 166/387 |
| 7,784,797 | B2 * | 8/2010 | Baugh et al. | 277/607 |
| 7,905,492 | B2 * | 3/2011 | Doane | 277/339 |
| 2003/0193145 | A1 * | 10/2003 | Reimert et al. | 277/336 |
| 2004/0216868 | A1 | 11/2004 | Owen, Sr. | 166/387 |
| 2005/0087345 | A1 | 4/2005 | Steele et al. | 166/380 |
| 2006/0185855 | A1 | 8/2006 | Jordan et al. | 175/5 |
| 2007/0000664 | A1 | 1/2007 | Ring et al. | 166/277 |
| 2007/0131413 | A1 | 6/2007 | Millet et al. | 166/115 |
| 2008/0296844 | A1 * | 12/2008 | Doane | 277/336 |
| 2008/0296845 | A1 * | 12/2008 | Doane | 277/337 |
| 2009/0139709 | A1 * | 6/2009 | Doane | 166/138 |
| 2009/0277651 | A1 * | 11/2009 | Kilgore | 166/387 |
| 2010/0038072 | A1 * | 2/2010 | Akselberg et al. | 166/118 |
| 2010/0326675 | A1 * | 12/2010 | Doane et al. | 166/387 |

OTHER PUBLICATIONS

Philip Head (XL Technology Ltd.) and Tim Hanson (Enterprise Oil PLC), "Slim Clearance-Small Diameter Reeled Exploration Wells and Conventional Well Deepening," Presentation at the SPE/ICoTA Coiled Tubing Roundtable, SPE 68507, pp. 7-8, Mar. 2001, Houston, Texas.

J. Rignol (Total E&P Nederland) and A. Parde, E. Thourenu & L. Verdillion (Vallourec & Mannesman Tubes), "Worldwide First Run in Hole of a Dope-Free 13Cr Production Tubing String," Presentation at the 2005 SPE Annual Technical Conference and Exhibition, SPE 95507, pp. 9-12, Oct. 11, 2005, Dallas, Texas.

* cited by examiner

HIGH-PRESSURE/HIGH TEMPERATURE PACKER SEAL

BACKGROUND OF THE INVENTION

1. Field of the Invention

The present invention generally relates to packer and sealing devices of the type used within a wellbore.

2. Description of the Related Art

There are generally two separate categories of designs for elastomeric wellbore packer seals: those that are set by axial compression and those that are set by moving the seal element radially outwardly with a ramp. Both of these designs are problematic when used at extreme wellbore depths wherein there are very high pressures and temperatures which tend to degrade elastomers. A compression set packer seal is compressed axially, which causes the seal element to expand radially until it contacts and seals against the inner radial surface of the surrounding casing or other tubular member. Compression set packers inherently require large volumes of elastomer, which is very expensive. In addition, it may be difficult or impossible to mold compression set packer elements from certain specialized elastomers that are resistant to high temperatures and pressures. Also at high pressures, the elastomeric seal element may become too soft to properly deploy anti-extrusion devices which prevent the elastomer from bleeding out along the axial space between the packer and the surrounding tubing.

Ramp set packer elements typically require the elastomeric sealing element to be bonded to a steel insert. But it is currently not feasible to bond elastomers that are greatly resistant to high temperatures and pressures to such inserts. Ramp set seals also have a tendency to leak when pressure is applied to the side with the smaller cross-section because the pressure pushes the seal element down the ramp. Even when a ratchet mechanism is used to try to retain the seal element on the ramp, there is still some inherent slippage that occurs.

SUMMARY OF THE INVENTION

The devices and methods of the present invention provide a packer design that overcomes a number of the problems of the prior art. A packer design in accordance with the present invention provides a reliable fluid seal which is highly resistant to degradation from high temperatures and pressures. In a preferred embodiment, a packer device is described which includes an elastomeric packer element which is seated upon an inner sleeve that surrounds a central inner mandrel. The inner sleeve and the inner mandrel are oriented at an angle of departure with respect to the central axis of the tool, thereby providing a ramp assembly which helps to set the packer device. An anchor ring and a retaining ring are located on opposite axial sides of the packer element. The retaining ring is secured to the sleeve, while the anchor ring is axially moveable with respect to the sleeve.

In operation, the packer device is incorporated into a production tubing string or other work string. A packer setting tool is incorporated into the production tubing string adjacent the packer device. The production tubing string is then deployed into a wellbore along with the setting tool. When a depth or location has been reached at which it is desired to set the packer device, the setting tool is actuated to move a setting sleeve axially. The setting sleeve contacts and moves the actuating ring of the packer device axially downwardly with respect to the central inner mandrel of the packer device. Downward movement of the actuating ring causes the retaining ring, inner sleeve, packer element and anchor ring components to be moved axially downwardly with respect to the inner mandrel. One the anchor ring is brought into contact with the surrounding tubular, downward movement of the anchor ring with respect to the surrounding tubular is halted, and a metal-to-metal barrier is formed between the anchor ring and the surrounding tubular.

As the setting sleeve continues to move axially downwardly, the sleeve and the actuating ring are moved further downwardly with respect to the inner mandrel. The packer element is axially compressed between the retaining ring and the anchor ring, thereby causing it to expand radially outwardly to form a resilient fluid seal against the surrounding tubular.

Eventually, downward movement of the setting sleeve will cause the actuating ring to be moved radially outwardly and into contact with the surrounding tubular. This contact creates a second metal-to-metal barrier between the packer device and the surrounding tubular. In preferred embodiments, the actuating ring is provided with at least one radially raised pip which can be crushed during setting of the packer device.

A number of alternative embodiments are described. In one alternative embodiment, the anchor ring is securely affixed to the inner sleeve. In other alternative embodiments, the actuating ring and/or the retaining ring is/are releasably secured to the inner sleeve. In still other alternative embodiments, multiple raised pips are provided on the actuating ring and/or the anchor ring. Further the outer radial surfaces of the actuating ring and/or the anchor ring may be coated with a metal or material that is softer than the material forming the rings.

BRIEF DESCRIPTION OF THE DRAWINGS

The advantages and other aspects of the invention will be readily appreciated by those of skill in the art and better understood with further reference to the accompanying drawings in which like reference characters designate like or similar elements throughout the several figures of the drawings and wherein.

DETAILED DESCRIPTION OF THE PREFERRED EMBODIMENTS

Figure 1:
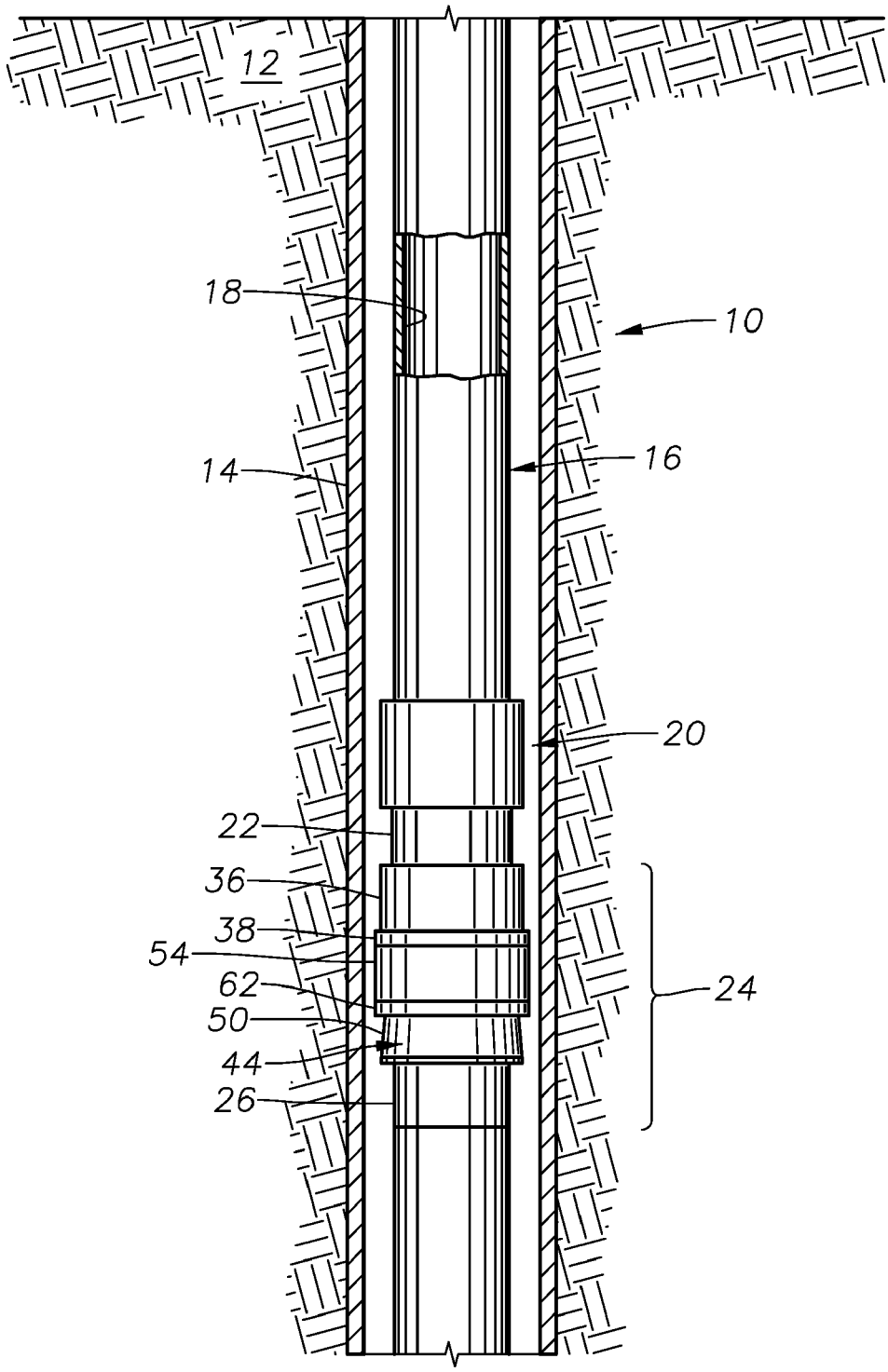
FIG. 1 is a side, cross-sectional view of an exemplary production tubing string having a packer device incorporated therein that is constructed in accordance with the present invention.

FIG. 1 illustrates an exemplary hydrocarbon production wellbore 10 that has been drilled through the earth 12 and has been lined with casing 14. A production tubing string 16 is disposed within the casing 14, having been run in from the surface (not shown) in a manner known in the art. A central flowbore 18 is defined along the length of the production tubing string 16. The production tubing string 16 may be formed of a number of interconnected production tubing sections, or it may be formed of coiled tubing. A packer setting tool 20 is incorporated into the production tubing string 16. The setting tool 20 operates to set a packer by axial movement of a setting sleeve 22. The setting tool 20 may be actuated electrically, hydraulically, or in other ways known in the art. Two commercially available setting tools which would be suitable for use as the setting tool 20 are the Baker Hughes Model "E-4" Wireline Setting Tool and the "BH" Hydraulic Setting Tool, both of which are available commercially from Baker Hughes Incorporated of Houston, Tex.

Figure 2:
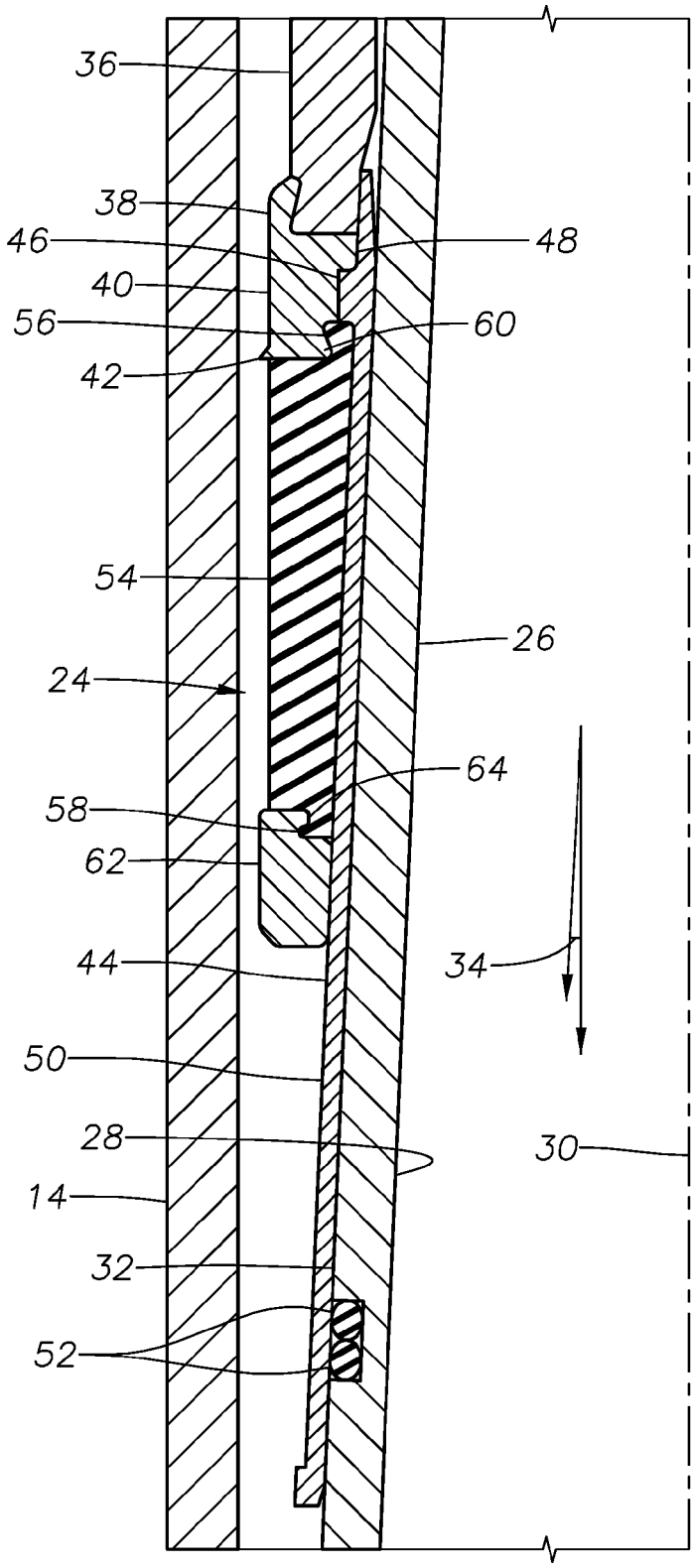
FIG. 2 is a side, one-quarter cross-sectional view of the packer device in an unset position.
Figure 3:
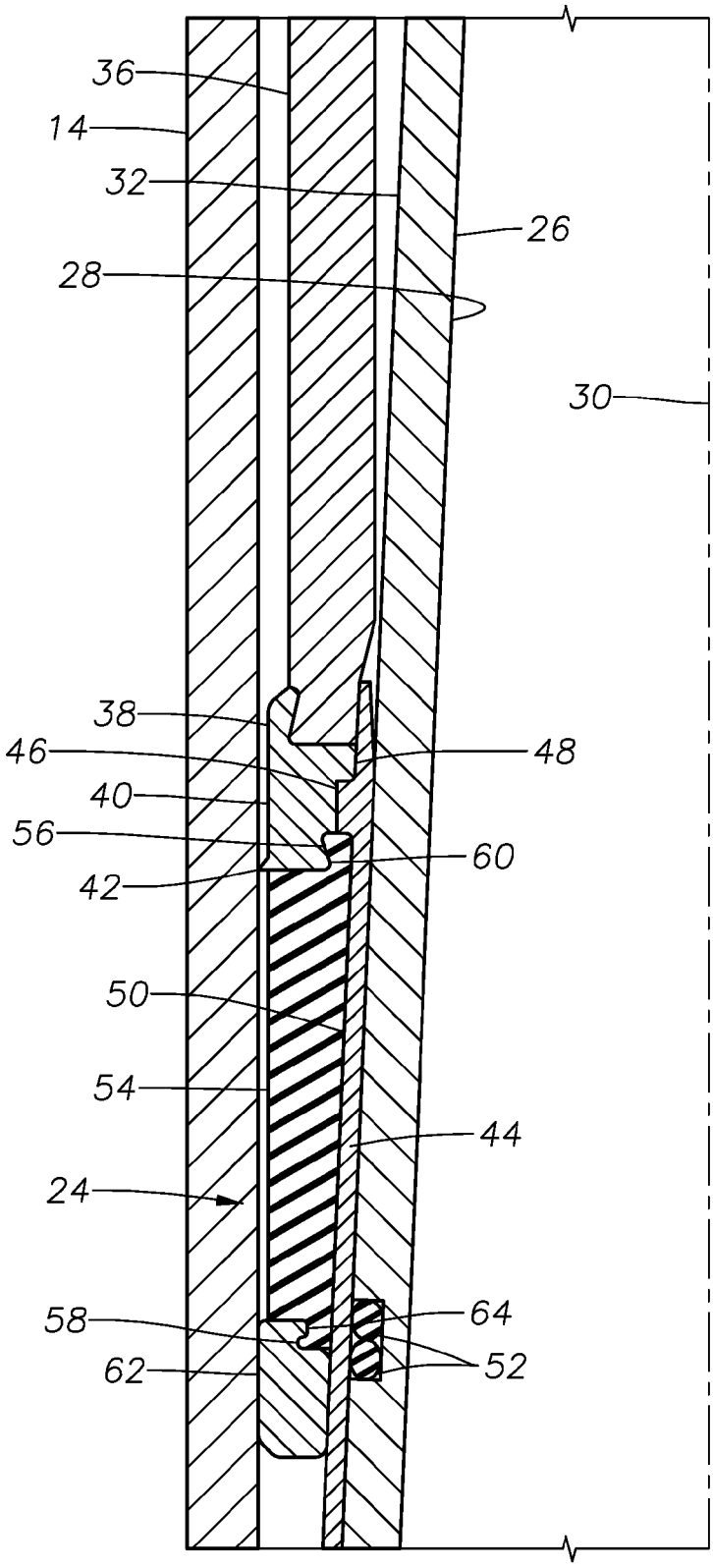
FIG. 3 is a side, one-quarter cross-sectional view of the packer device shown in FIG. 2, now in a partially set position.

A packer device 24, constructed in accordance with the present invention, is also incorporated into the production tubing string 16 adjacent to the setting tool 20. The packer device 24 is depicted in greater detail in FIGS. 2 and 3. The packer device 24 includes a central inner mandrel 26 which defines a central flowbore 28. The inner mandrel 26 has a central axis along its length, which is depicted by the dashed line 30. The inner mandrel 26 presents an outer radial surface 32 which is angled with respect to the central axis 30. The angle of departure from the central axis 30 is illustrated by angle 34 in FIG. 2. In a currently preferred embodiment, the angle of departure 34 is 3 degrees. The inner mandrel 26 will typically be provided with threaded axial ends, as are known in the art, for incorporating the packer device 24 into the production tubing string 16.

The packer device 24 also includes an upper metallic actuating ring 36 which radially surrounds the inner mandrel 26 and abuts the setting sleeve 22 of the setting tool 20. The actuating ring 36 is affixed, at its lower end, to a substantially rigid retaining ring 38. Preferably, the retaining ring 38 is metallic. The retaining ring 38 presents a radially outer surface 40 with a raised deformable pip 42.

An inner sleeve 44 radially surrounds the inner mandrel 26 and is slidably moveable with respect to the inner mandrel 26. The sleeve 44 has a radially outwardly projecting flange 46 which abuts a radially inwardly projecting flange 48 on the retaining ring 38. The sleeve 44 also presents an outer ramp surface 50. Annular fluid seals 52 are preferably disposed between the sleeve 44 and the inner mandrel 26.

An elastomeric packer element 54 radially surrounds the sleeve 44 and is slidably moveable upon the ramp surface 50. The packer element 54 includes axial end lips 56 and 58. The upper lip 56 is mechanically interlocked with complimentary flange 60 on the retaining ring 38.

A substantially rigid anchor ring 62 surrounds the sleeve 44 and the inner mandrel 26 and is slidably moveable with respect to the sleeve 44. Typically, the anchor ring 62 is metallic. The anchor ring 62 has an inwardly directed flange 64 which is shaped and sized to be complimentary to the lip 58 of the packer element 54. The lip 58 and flange 64 are mechanically interlocked to secure the anchor ring 62 and the packer element 54 together. The use of mechanical interlocks between the lips 56, 58 and the flanges 60, 64 eliminates the need to use bonding to secure the elastomer of the packer element 54 to a rigid component.

In operation, the packer device 24 and setting tool 20 are run into the wellbore 10 with the production tubing string 16. The packer device 24 is in the unset position shown in FIG. 2. When a depth has been reached wherein it is desired to set the packer 24, the setting tool 20 is actuated to move the setting sleeve 22 axially downwardly against the actuating ring 36 of the packer device 24. The actuating ring 36 urges the retaining ring 38 and sleeve 44 axially downwardly with respect to the inner mandrel 26. Due to the angle of departure 34 of the outer radial surface 32, the packer device 24 is moved to the position depicted in FIG. 3 wherein the anchor ring 62 is moved radially outwardly and into contact with the casing 14. Downward axial movement of the anchor ring 62 with respect to the mandrel 26 is halted by this contact. The contact between the packer device 24 and the casing 14 helps to prevent extrusion of the elastomeric material forming the packer element 54 axially outwardly between the packer device 24 and the casing 14.

Figure 4:
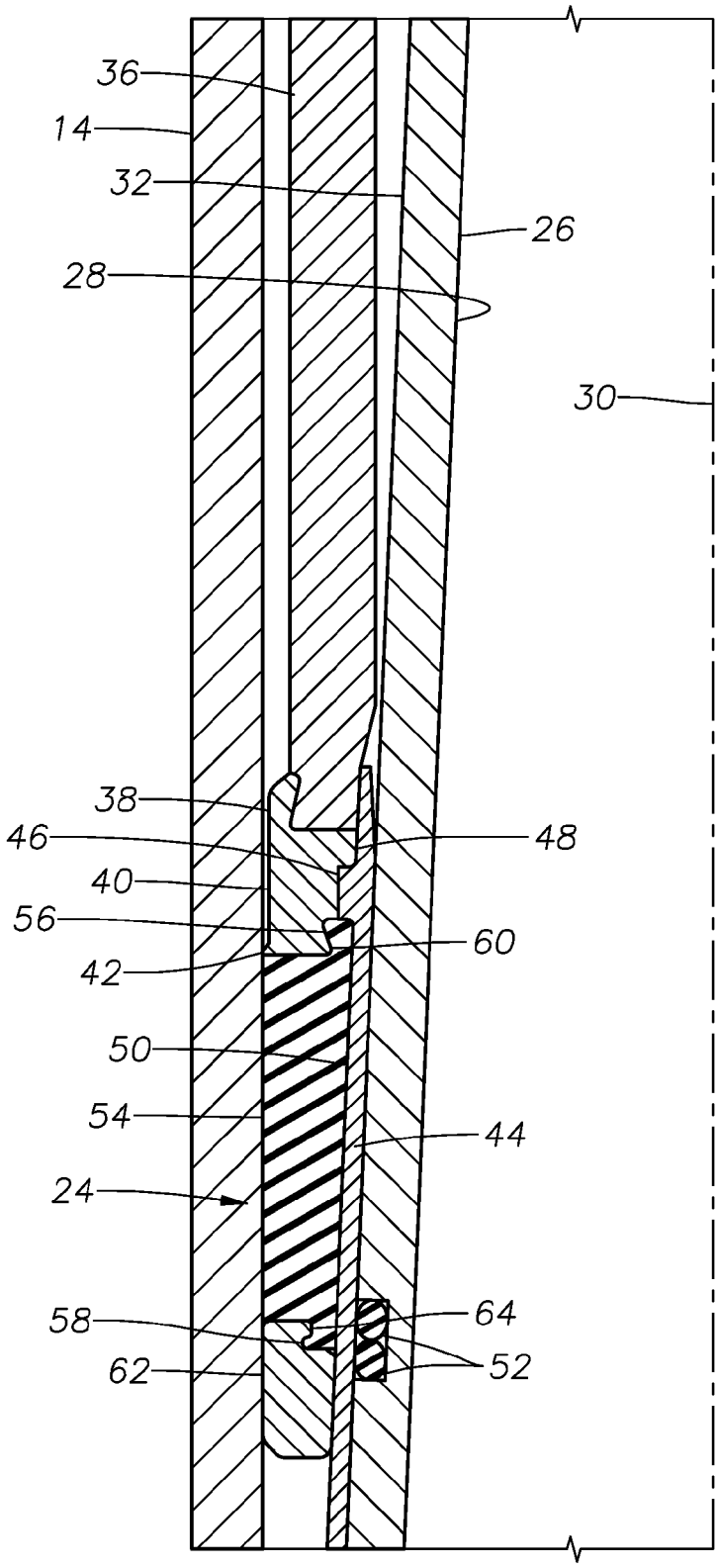
FIG. 4 is a side, one-quarter cross-sectional view of the packer device shown in FIGS. 2 and 3, now in a fully set position.

As the setting sleeve 22 is further moved axially downwardly by the setting tool 20, the actuating ring 36 and the sleeve 44 are also moved axially downwardly. Because downward axial movement of the anchor ring 62 has been stopped, downward movement of the retaining ring 38 will urge the packer element 54 against the anchor ring 62. The packer element 54 is axially compressed between the retaining ring 38 and the anchor ring 62 and will be expanded radially outwardly, as depicted in FIG. 4. The packer element 54 will be brought into contact with the casing 14, and forms a resilient fluid seal against the casing 14. As the retaining ring 38 and sleeve 44 are moved axially downwardly, the sleeve 44 is permitted to slide downwardly upon the outer radial surface 32 of the inner mandrel 26. The seals 52 provide a fluid seal between the sleeve 44 and the inner mandrel 26 so that any fluid path between the sleeve 44 and the inner mandrel 26 is closed off. As the packer element 54 is set by compression between the retaining ring 38 and the anchor ring 62, the radial expansion of the packer element 54 will also energize the seals 52.

As the setting sleeve 22 moves axially downwardly further still, the angle 34 of the outer radial surface 32 of the inner mandrel 26 will cause the retaining ring 38 to be brought into contact with the casing 14. Initially, the raised pip 42 of the retaining ring 38 will make contact with the casing 14 (see FIG. 4). Further downward pressure on the retaining ring 38 by the actuating ring 36 will cause the pip 42 to deform and flatten to cause the outer radial surface 40 of the retaining ring 38 to be brought into contact with the surrounding casing 14. The pip 42 is an anti-extrusion mechanism for the elastomeric material making up the packer element 54. Because the interior surface of the casing 14 is not perfectly cylindrical, the pip 42 will compensate by deforming more where the casing 14 is smaller (i.e., a smaller space between the casing 14 and the retaining ring 38) and deform less where the casing 14 is larger. This variable deformation allows the pip 42 to contact the interior diameter of the casing 14 around its complete circumference. The retaining ring 38 provides a second contact between the packer device 24 and the casing 14 which helps prevent axially extrusion of the elastomeric material of the packer element 54 outwardly between the packer device 24 and the casing 14.

In the event that the packer device 24 is to be removed, the setting device 20 is actuated to move the setting sleeve 22 axially upwardly with respect to the packer device 24, thereby reversing the axial compression of the packer element 54. If the packer device 24 is intended to be removed, the setting sleeve 22 and the actuating ring 36 are preferably affixed together via complimentary latching fingers, collets, connecting pins, threading, or in other ways known in the art, so that upward movement of the setting sleeve 22 will also move the actuating ring 36 upwardly. As the actuating ring 36 is moved upwardly, it will cause the affixed retaining ring 38 to move upward also thereby helping to unset the packer element 54.

Figure 5:
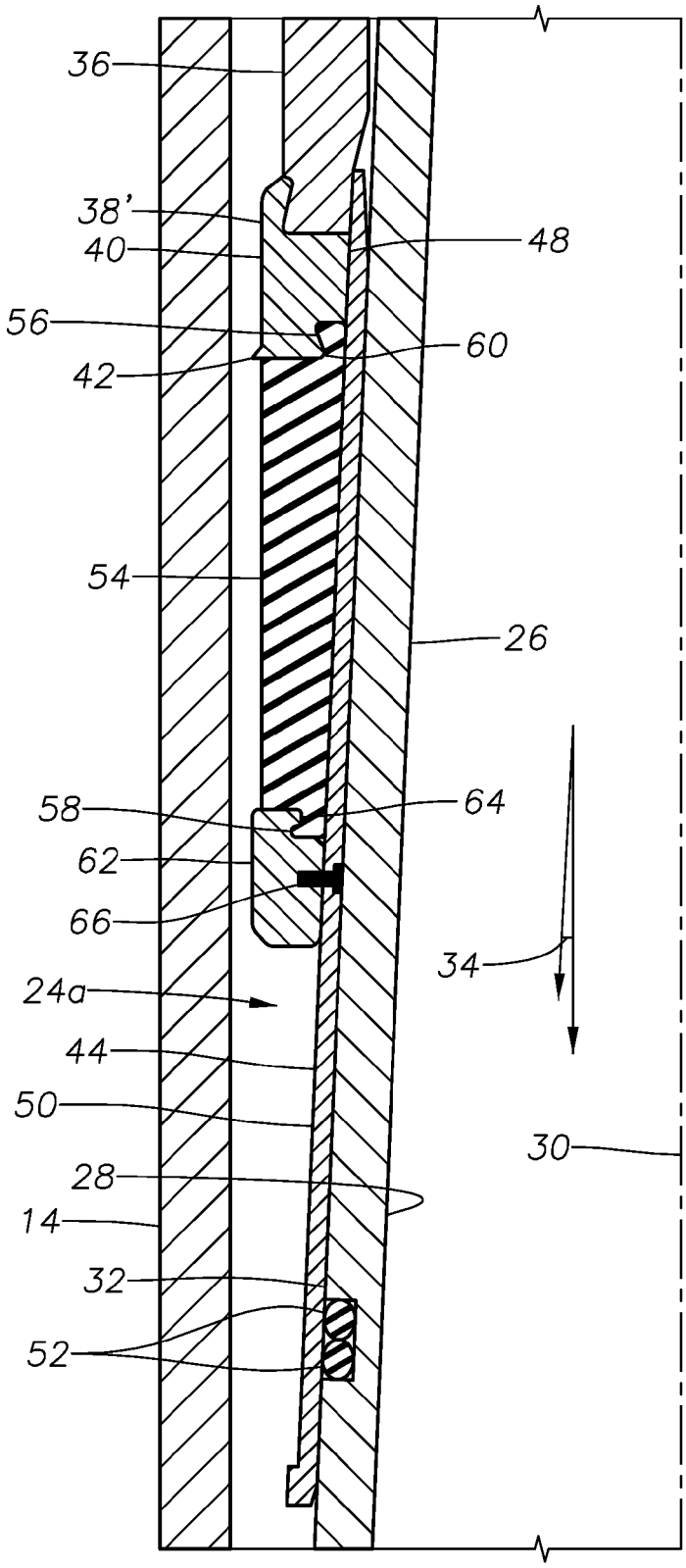
FIG. 5 depicts an alternative embodiment for a packer device in accordance with the present invention wherein the anchor ring is securely affixed to the inner sleeve.
Figure 6:
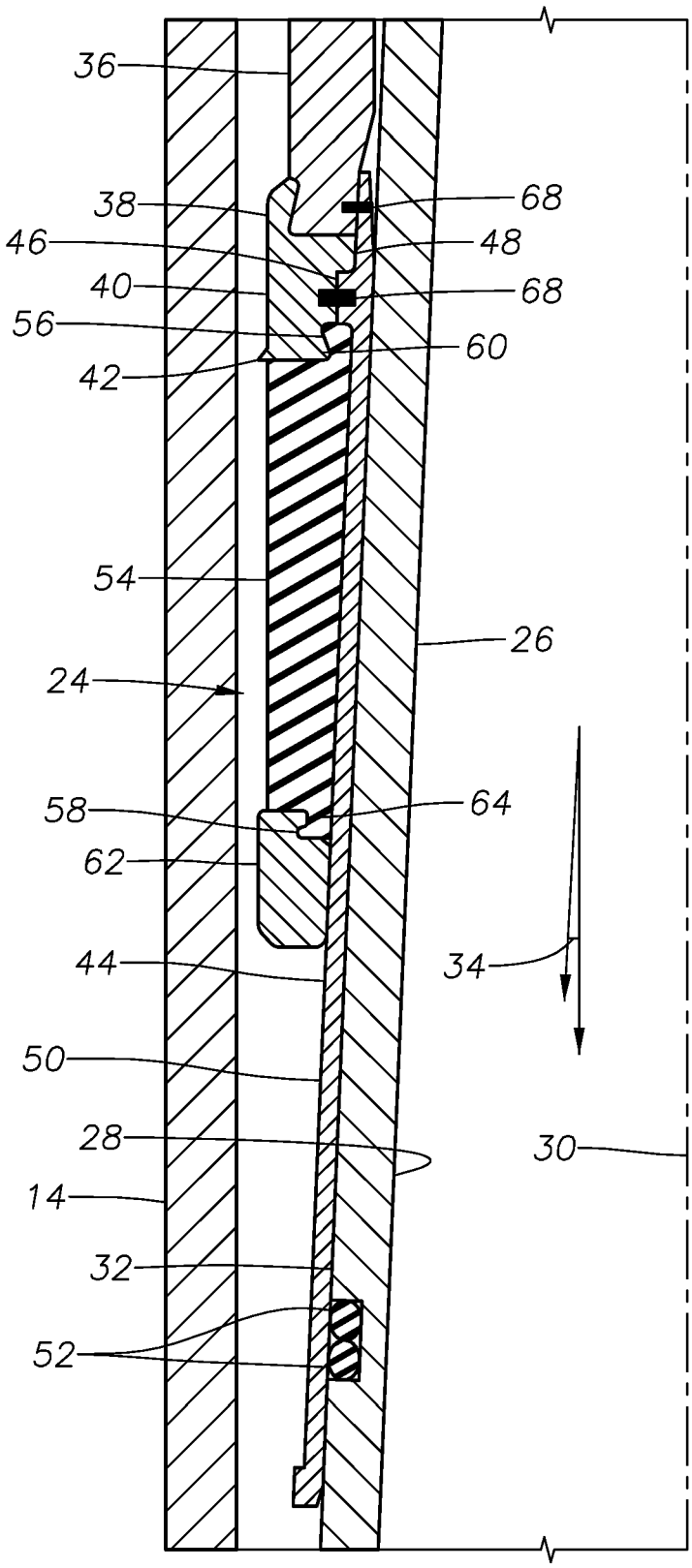
FIG. 6 depicts a further alternative embodiment for a packer device in accordance with the present invention wherein the actuating ring and retaining ring are releasably secured to the inner sleeve.

Alternative constructions for packer assemblies in accordance with the present invention are depicted in FIGS. 5 and 6. FIG. 5 depicts an alternative packer device 24*a* wherein the anchor ring 62 of packer device 24*a* is rigidly affixed to the sleeve 44 via one or more pins 66 or other connectors, of a type known in the art. Alternatively, the anchor ring 62 could be secured to the inner sleeve 44' by means of threading, splining or in other ways known in the art. In addition, the radially outwardly extending flange 46 of the inner sleeve 44' is not present, so that the retaining ring 38' can slide axially with respect to the inner sleeve 44'. When the packer device 44*a* is constructed in this manner, downward movement of the setting sleeve 22 will cause the actuating ring 36, retaining ring 38', sleeve 44, packer element 54 and anchor ring 62 to all move axially downwardly upon the outer radial surface 32 of the inner mandrel 26. The anchor ring 62 will contact the casing 14, as previously described, to form a first metal-to-metal seal between the packer device 24*a* and the casing 14. Thereafter, further downward movement of the setting sleeve 22 will move the actuating ring 36 and retaining ring 38' downwardly to axially compress the packer element 54 between the retaining ring 38' and the anchor ring 62. The packer element 54 will create a resilient seal against the casing 14. The retaining ring 38' will also be brought into contact the casing 14, as previously described, and will form a second metal-to-metal seal between the packer device 24*a* and the casing 14.

FIG. 6 illustrates a further alternative embodiment for a packer device 24*b*, in accordance with the present invention. In FIG. 6, the actuating ring 36 and the retaining ring 38 are releasably secured to the inner sleeve 44 with the use of one or more shear members, such as shear screws 68. Although both the actuating ring 36 and the retaining ring 38 are shown releasably affixed to the inner sleeve 44 in FIG. 6, those of skill in the art will understand that either the actuating ring 36 or the retaining ring 38 may be independently affixed to the sleeve 44 in a releasable manner without the other being so attached. The packer device 24*b* is operated in essentially the same manner as the packer device 24 described previously. However, the shear screws 68 preclude early movement of the actuating ring 36 or retaining ring 38 which might cause early setting or early partial setting of the packer device 24*b*.

In other variations for a packer device constructed in accordance with the present invention, one or more metal back-up rings may be added as an extrusion barrier for the packer element 54. Additionally, the surfaces of the retaining ring 38 and/or the anchor ring 62 which will contact the casing 14 may be plated with a softer metal, such as silver, or another material that is softer than the material used to form the rings 38, 62. Rings 38 and 62 are preferably fashioned from a hardened metal, such as annealed AISI 8620. One advantage of plating is that the material used to plate the rings 38 and/or 62 will deform into any inconsistencies or gaps within the casing 14 surface in order to help prevent the elastomeric material making up the packer element 54 from bleeding between the packer device 24 and the casing 14. Also, raised pips, such as pip 42, may be formed on the anchor ring 62, and multiple raised pips can be formed on both or either of the retaining ring 38 and the anchor ring 62.

It should be understood that the angled outer radial surface 32 of the inner mandrel 26 and the sleeve 44 collectively provide a ramp assembly that will move the packer element 54, the anchor ring 62 and the retaining ring 38 radially outwardly as they are moved axially with respect to the inner mandrel 26.

Those of skill in the art will understand that the components of the various described packer devices 24, 24*a*, 24*b* may be inverted so that the packer element 54 and other components are moved axially upwardly with respect to the inner mandrel 26. In this instance, the setting tool 20 may be located below the packer device 24, 24*a* or 24*b* in the production tubing string 16.

Those of skill in the art will recognize that numerous modifications and changes may be made to the exemplary designs and embodiments described herein and that the invention is limited only by the claims that follow and any equivalents thereof.

What is claimed is:

1. A packer device for forming seals against a surrounding tubular member in a wellbore, the packer device comprising:

an inner mandrel having a central axis and presenting an outer radial surface that is disposed at an angle of departure with respect to the central axis;

an inner sleeve radially surrounding and slidable upon the mandrel, the sleeve presenting a radially outer ramp surface; and an elastomeric packer element radially surrounding the inner sleeve and slidable upon the ramp surface and being set by both 1) being axially moved radially outwardly due to axial movement along the outer radial surface and 2) being axially compressed to form a resilient seal against the surrounding tubular member.

2. The packer device of claim 1 further comprising a substantially rigid anchor ring slidably moveable upon the ramp surface and forming a first contact against the surrounding tubular member upon axial movement of the sleeve on the outer radial surface.

3. The packer device of claim 2 wherein the anchor ring is mechanically interlocked with the packer element.

4. The packer device of claim 2 further comprising a substantially rigid retaining ring radially surrounding the inner mandrel and forming a second contact against the surrounding tubular member upon axial movement of the inner sleeve on the outer radial surface.

5. The packer device of claim 4 wherein the retaining ring is mechanically interlocked with the packer element.

6. The packer device of claim 4 wherein the retaining ring presents a radially outer surface for forming a contact with the surrounding tubular and wherein a deformable raised portion is formed upon the radially outer surface.

7. The packer device of claim 2 wherein the packer element is axially compressed by movement of the anchor ring upon the ramp surface.

8. The packer device of claim 7 further comprising a fluid seal disposed between the sleeve and the inner mandrel.

9. The packer device of claim 1 wherein the angle of departure is about 3 degrees.

10. A packer device for forming seals against a surrounding tubular member in a wellbore, the packer device comprising:

an inner mandrel having a central axis and presenting an outer radial surface that is disposed at an angle of departure with respect to the central axis;

an inner sleeve radially surrounding and slidable upon the mandrel, the sleeve presenting a radially outer ramp surface;

an elastomeric packer element radially surrounding the inner sleeve and slidable upon the ramp surface and being set by both 1) being axially moved radially outwardly due to axial movement along the outer radial surface and 2) being axially compressed to form a resilient seal against the surrounding tubular member; and a substantially rigid anchor ring slidably moveable upon the ramp surface and forming a first contact against the surrounding tubular member upon axial movement of the sleeve on the outer radial surface.

11. The packer device of claim 10 wherein the anchor ring is mechanically interlocked with the packer element.

12. The packer device of claim 10 further comprising a substantially rigid retaining ring radially surrounding the inner mandrel and forming a second contact against the surrounding tubular member upon axial movement of the inner sleeve on the outer radial surface.

13. The packer device of claim 12 wherein the retaining ring is mechanically interlocked with the packer element.

14. The packer device of claim 12 wherein the retaining ring presents a radially outer surface for forming a contact with the surrounding tubular and wherein a deformable raised portion is formed upon the radially outer surface.

15. The packer device of claim 10 wherein the angle of departure is about 3 degrees.

16. The packer device of claim 10 wherein the packer element is axially compressed by movement of the anchor ring upon the ramp surface.

17. The packer device of claim 16 further comprising a fluid seal disposed between the sleeve and the inner mandrel, the fluid seal being energized upon the setting of the packer device.

18. A method of setting a packer device within a surrounding tubular member, the method comprising the steps of:

forming a first contact between an anchor ring of the packer device and the surrounding tubular member, the anchor ring being slidably moveable upon a ramp surface of a sleeve that radially surrounds and is moveable upon a mandrel;

radially expanding a packer element that is in contact with the anchor ring and forming a resilient seal between the packer element and the surrounding tubular member;

forming a second contact between a retaining ring of the packer device and the surrounding tubular member; and compressing the packer element between the anchor ring and the retaining ring by sliding the anchor ring upon the ramp surface.

* * * * *